US011937723B2

(12) United States Patent
Su

(10) Patent No.: US 11,937,723 B2
(45) Date of Patent: Mar. 26, 2024

(54) BABY SLEEPING BAG

(71) Applicant: WONDERLAND SWITZERLAND AG, Steinhausen (CH)

(72) Inventor: Yuya Su, Taipei (TW)

(73) Assignee: Wonderland Switzerland AG, Steinhausen (CH)

( * ) Notice: Subject to any disclaimer, the term of this patent is extended or adjusted under 35 U.S.C. 154(b) by 42 days.

(21) Appl. No.: 17/534,985

(22) Filed: Nov. 24, 2021

(65) Prior Publication Data

US 2022/0160150 A1 May 26, 2022

(30) Foreign Application Priority Data

Nov. 26, 2020 (CN) ..... 202022789119.5

(51) Int. Cl.
*A47G 9/08* (2006.01)

(52) U.S. Cl.
CPC ..... *A47G 9/083* (2013.01)

(58) Field of Classification Search
CPC ..... A47G 9/083; A47G 9/068; A47D 15/005; A47D 15/006; A47D 15/008; A41B 13/06
See application file for complete search history.

(56) References Cited

U.S. PATENT DOCUMENTS 1,940,224 A * 12/1933 Munro ..... A41B 13/06 5/413 R
6,055,686 A * 5/2000 Knight ..... A47G 9/068 5/413 R
6,145,932 A * 11/2000 Hamel-Nyhus ..... B60N 2/2881 297/219.12
6,817,033 B2 * 11/2004 Bailey ..... A41B 13/06 2/69.5
6,859,960 B1 * 3/2005 Jerome ..... A47G 9/08 5/413 R
7,076,816 B1 * 7/2006 Nielsen ..... A47G 9/062 383/4
8,032,958 B2 * 10/2011 Pieta ..... A41B 13/06 5/655
9,332,791 B1 * 5/2016 Bush ..... A47D 15/003
(Continued)

FOREIGN PATENT DOCUMENTS

CN 210383383 U 4/2020
CN 111700318 A 9/2020
(Continued)

*Primary Examiner* — Justin C Mikowski
*Assistant Examiner* — Amanda L Bailey
(74) *Attorney, Agent, or Firm* — Volpe Koenig

(57) ABSTRACT

This disclosure provides a baby sleeping bag including a bag body and an arm securing structure in the bag body. The arm securing structure includes a securing sheet arranged on an inner wall of the bag body along a transverse width direction of the bag body. A limit space for securing the baby's arms is formed between the securing sheet and the inner wall of the bag body, and a size of the limit space is adjustable. When the baby lies in the sleeping bag, the upper body of the baby may be wrapped in the limit space defined by the securing sheet and the inner wall of the bag body, so as to limit the movement of the baby's arms, effectively preventing the arm from being stretched out of the sleeping bag, and thus avoiding the baby from catching a cold.

21 Claims, 10 Drawing Sheets

(56) References Cited

U.S. PATENT DOCUMENTS

| | | | | |
|---|---|---|---|---|
| 2004/0019969 | A1* | 2/2004 | Gatten | A41B 13/06 2/69.5 |
| 2011/0179546 | A1* | 7/2011 | Millette | A41B 13/06 2/75 |
| 2015/0237934 | A1* | 8/2015 | Kirkland | A41D 13/1281 2/455 |
| 2019/0239573 | A1 | 8/2019 | Mercy | |
| 2021/0259329 | A1* | 8/2021 | Kiik-Miley | A41B 13/005 |
| 2022/0256940 | A1* | 8/2022 | Hoshi | A47G 9/0223 |

FOREIGN PATENT DOCUMENTS

| | | | | |
|---|---|---|---|---|
| EP | 1190631 | A2 * | 3/2002 | A41B 13/06 |
| TW | M340009 | U | 9/2008 | |

* cited by examiner

BABY SLEEPING BAG

CROSS-REFERENCE TO RELATED APPLICATIONS

The present application is based on and claims the benefit of and priority to Chinese Patent Application No. 202022789119.5, filed on Nov. 26, 2020, the entire contents of which being incorporated herein by reference.

TECHNICAL FIELD

The present disclosure relates to the technical field of baby articles, in particular to a baby sleeping bag.

BACKGROUND

With the popularization of scientific parenting knowledge, more and more parents have recognized the need to give their baby an independent sleep space. However, for a baby who is sleeping alone, the problem that the baby would kick the quilt away during his/her sleeping and thus catch a cold may occur. Accordingly, the baby sleeping bag is developed as a sleeping product for preventing the quilt from being kicked away, and is favored by many parents. However, most of traditional baby sleeping bags wrap around the entire body of the baby, and many babies like sleeping with their hands raised (like a "surrender" posture), so that their arms are always stretched out of the sleeping bags, and thus the babies are easy to catch a cold.

Therefore, it is necessary to provide a baby sleeping bag which can secure the baby's arms, has a simple structure and is convenient to use, so as to solve the problems existing in the prior art.

SUMMARY

An objective of the present disclosure is to provide a baby sleeping bag with heat preservation function, simple structure and convenient use.

In order to achieve the above objective, the present disclosure provides a baby sleeping bag including a bag body and an arm securing structure arranged in the bag body. The arm securing structure includes a securing sheet arranged on an inner wall of the bag body along a transverse width direction of the bag body, and a limit space for securing the baby arm may be formed between the securing sheet and the inner wall of the bag body, a size of the limit space is adjustable.

Preferably, the securing sheet has a connecting end and a free end, the connecting end and the free end are correspondingly connected to opposite sides (i.e., left and right sides) of the bag body, and at least one of the connecting end and the free end is detachably connected with the bag body.

Preferably, the number of the securing sheet is one, the connecting end of the securing sheet is fixedly connected with the left side of the bag body, and the free end of the securing sheet is detachably connected with the relatively right side of the bag body.

Preferably, the number of the securing sheet is two, a securing sheet is respectively provided on the left and right opposite sides of the bag body at a position corresponding to each arm of the baby, and the free ends of the two securing sheets are detachably connected.

Preferably, the two securing sheets are arranged symmetrically.

Preferably, the free ends of the two securing sheets are detachably connected by means of superposing, lapping or docking.

Preferably, the arm securing structure also includes a connecting member, and the connecting member is arranged between the free ends of the two securing sheets to realize the detachable connection between the free ends of the two securing sheets.

Preferably, the arm securing structure also includes a connecting member, and the connecting member is arranged between the inner wall of the bag body and the free end or/and between the inner wall of the bag body and the connecting end, so as to realize the detachable connection between the free end or/and the connecting end and the inner wall of the bag body.

Preferably, the connecting member is any one of a set of securing buckle and securing ring that are detachably matched, a plugging fastener, a snap fastener, a Velcro® or a bandage.

Preferably, the arm securing structure also includes an adjusting element, the adjusting element is arranged between the free ends of the two securing sheets, or between the connecting end and the free end of at least one of the securing sheets, or between the connecting end of at least one of the securing sheets and the inner wall of the bag body, and the adjusting element is arranged along the transverse width direction of the bag body and has at least one adjusting section to adjust the size of the limit space.

Preferably, the arm securing structure also includes an adjusting element, the adjusting element is arranged between the inner wall of the bag body and the free end, or between the inner wall of the bag body and the connecting end, or between the connecting end and the free end of the securing sheet, and the adjusting element is arranged along the transverse width direction of the bag body and is provided with at least one adjusting section to adjust the size of the limit space.

Preferably, the adjusting element is any one of a set of securing buckle and a securing ring that are detachably matched, a pull rope, a snap fastener, a Velcro® or a bandage.

Preferably, the securing sheet is rectangular, and the free end of the securing sheet has a certain radian.

Preferably, the securing sheet may be stored or folded on the inner wall of the bag body.

Preferably, the arm securing structure also includes a storage bag, the storage bag is arranged on the inner wall of the bag body and is located near the connecting end of the securing sheet, and the securing sheet may be rolled towards the storage bag so as to be stored in the storage bag.

Preferably, the connecting end of the securing sheet is fixedly connected to an edge of an inner wall or outer wall of the storage bag, and the free end of the securing sheet may be rolled towards the storage bag so as to be stored in the storage bag.

Preferably, the storage bag is sewn or detachably connected to the inner wall of the bag body, and a mouth of the storage bag may be provided with a sealing member.

Preferably, the arm securing structure also includes a storage bag, a cloth sheet is connected to the securing sheet by means of sewing at a position close to the connecting end of the securing sheet, and the storage bag with an opening is formed between the cloth sheet and the securing sheet.

Preferably, the arm securing structure also includes a folding member, and the folding member is arranged on the inner wall of the bag body and arranged on the opposite sides (i.e., left and right sides) of the securing sheet along the transverse width direction of the bag body, so that the folded securing sheet can be fixed on the bag body.

Preferably, the folding member is any one of a set of securing buckle and securing ring that are detachably matched, a plugging fastener, a snap fastener, a Velcro® or a bandage.

Preferably, the securing sheet has certain scalability.

Preferably, the bag body includes a main body and a head cover that are integrally connected, the head cover is protruded at a top side end of the main bag, the securing sheet is arranged on the main body along a transverse width direction thereof, and the main body is provided with a closable opening arranged along its longitudinal direction.

Compared with the prior art, the arm securing structure of the baby sleeping bag provided by the present disclosure is arranged in the bag body, which is convenient to carry and use. The securing sheet of the arm securing structure is arranged on the inner wall of the bag body along the transverse width direction of the bag body, so that a limit space for securing the baby arm may be formed between the securing sheet and the inner wall of the bag body. When the baby lies in the sleeping bag, the upper body of the baby may be wrapped in the limit space defined by the securing sheet and the inner wall of the bag body, so as to limit the movement of the arms of the baby, effectively preventing the arms from being stretched out of the sleeping bag, and thus avoiding the occurrence that the baby catches a cold. The baby sleeping bag of the present disclosure has a simple structure and is convenient to use. In addition, the adjustable size of the limit space in the baby sleeping bag is convenient for babies to be placed in the sleeping bag, further improves the convenience of use, is suitable for babies of different statures, and effectively improves the adaptability of the baby sleeping bag.

DETAILED DESCRIPTION

An embodiment of the present disclosure is now described with reference to the accompanying drawings, in which similar element numbers represent similar elements.

Referring to FIGS. 1-8, the baby sleeping bag 100 provided by a preferred embodiment of the present disclosure includes a bag body 10 and an arm securing structure 20 arranged in the bag body 10. The arm securing structure 20 is used to limit the activities of arms of the baby sleeping in the bag body 10, so as to prevent the arms from being stretched out of the bag body 10 and thus avoiding the baby from catching a cold. The arm securing structure 20 includes a securing sheet 21 arranged on an inner wall of the bag body 10 along a transverse width direction of the bag body 10, so that a limit space 20*a* for securing the arms of the baby may be formed between the securing sheet 21 and the inner wall of the bag body 10. When the baby is sleeping in the baby sleeping bag 100, the upper body of the baby is wrapped in the limit space 20*a*, so that the securing sheet 21 can effectively limit the activity range of the baby and prevent his/her arms from being stretched out of the limit space 20*a*, so as to avoid the baby from catching a cold. The securing sheet 21 can also protect the chest and abdomen of the baby, and thus strengthen the heat preservation. In addition, in order to be suitable for babies of different figures and ages, a size of the limit space 20*a* is adjustable.

Figure 1:
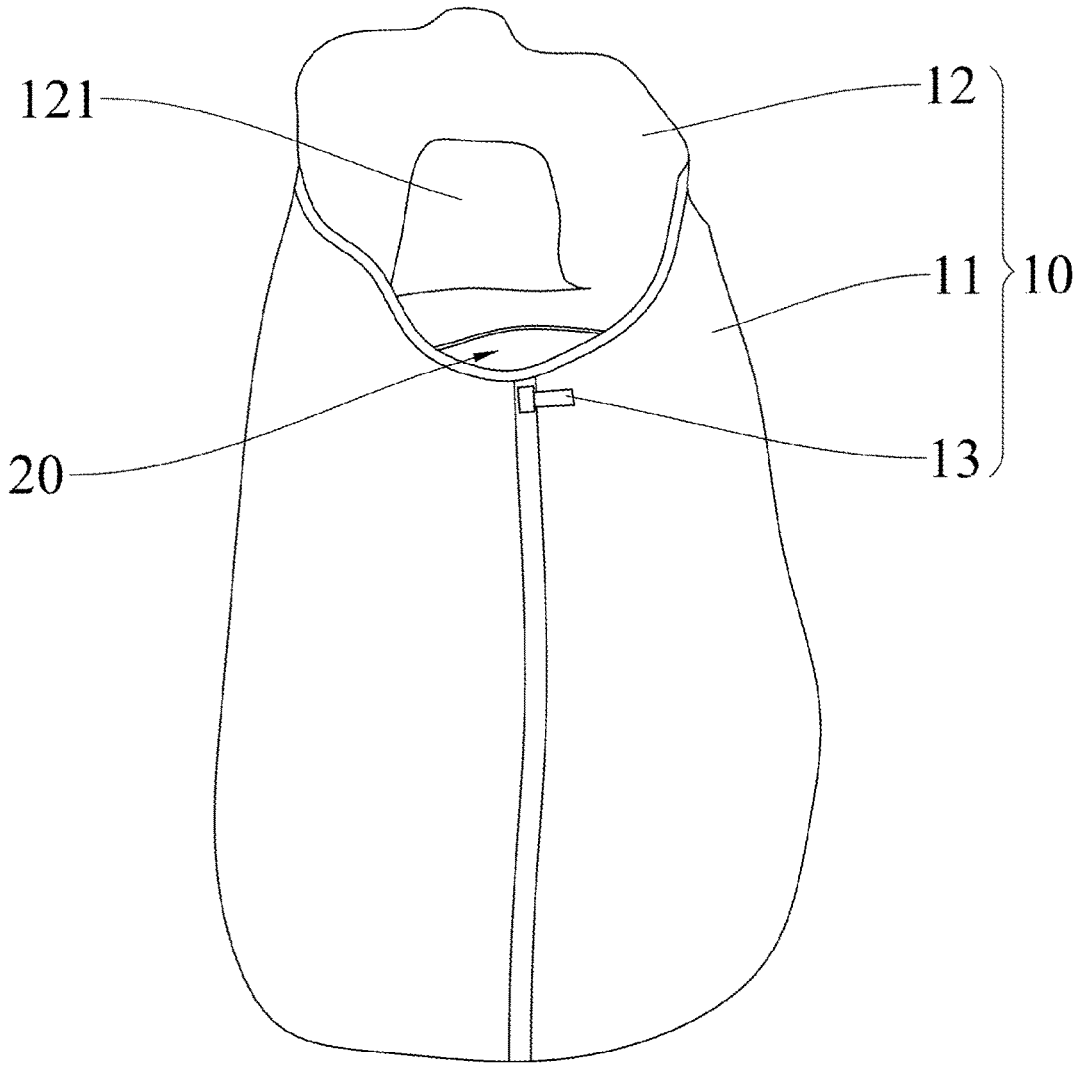
FIG. 1 is a schematic view of a use state according to an embodiment of the baby sleeping bag of the present disclosure.
Figure 2:
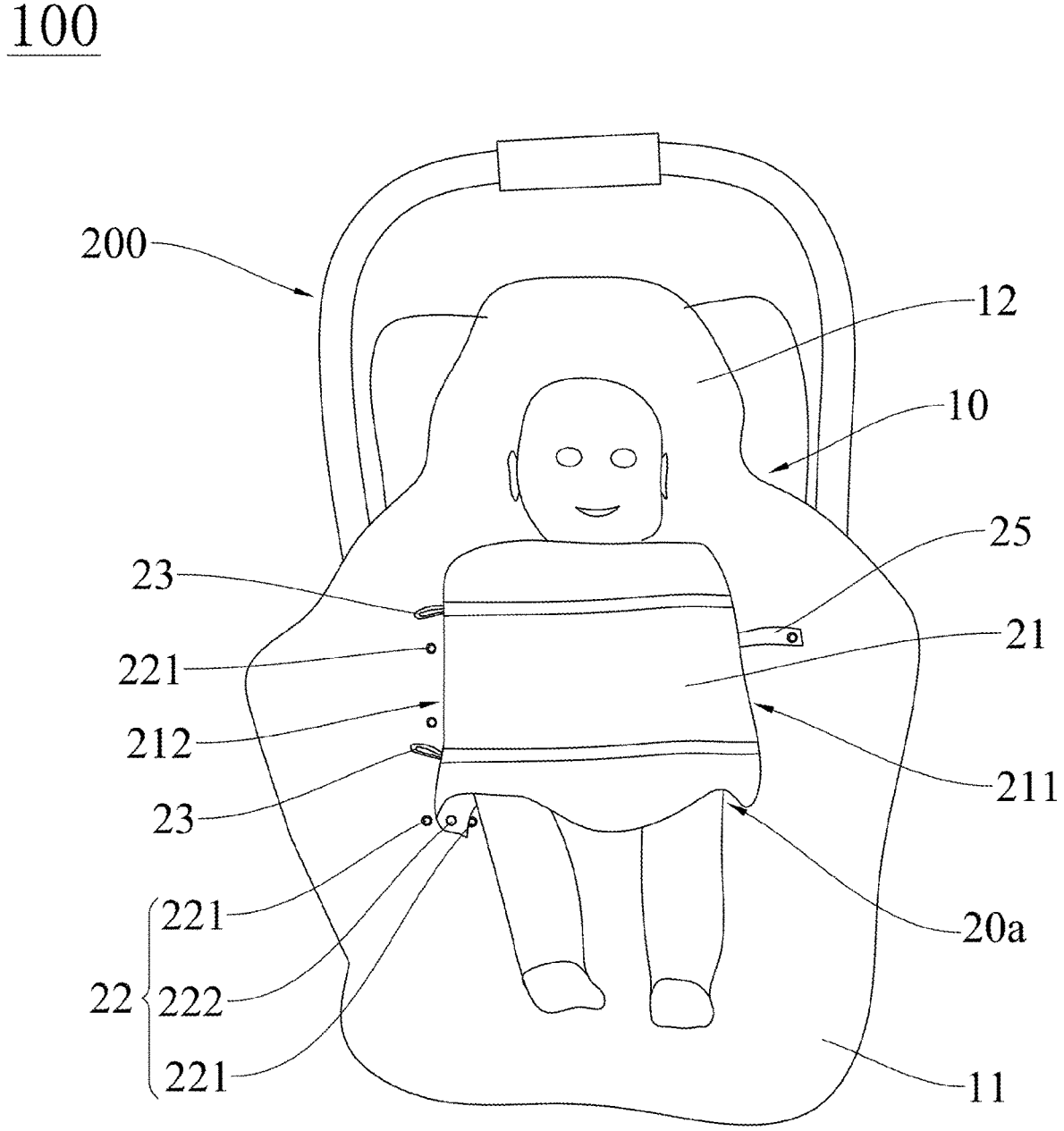
FIG. 2 is a structural schematic view of an arm securing structure according to the embodiment of the present disclosure.

Referring to FIGS. 1 and 2, the bag body 10 is in a convex shape as a whole, and includes a main body 11 and a head cover 12 which are integrally connected. The main body 11 is cylindrical for the baby to sleep inside, the head cover 12 is protruded at a top side end of the main body 11, so that the head and neck of the baby is outside the main body 11, and the securing sheet 21 is specifically arranged on the relatively upper side of the main body 11 along the transverse width direction of the main body 11. Specifically, the head cover 12 is provided with a securing portion 121 for supporting and securing the head and neck of the baby, so as to improve the safety and comfort. For ease of use, the main body 11 is provided with an opening arranged along its longitudinal direction, and the opening may be opened and closed via a sealing member 13. When in use, the sealing member 13 may be operated to open the opening on the main body 11, so that the baby can be conveniently placed in the main body 11. The upper body of the baby may be wrapped in a limit space 20 *a*, and then the opening may be closed through the sealing member 13 to safely and warmly wrap the baby in the cylindrical main body 11. The sealing member 13 is any one of a zipper, a snap fastener, a Velcro® or a bandage.

As shown in FIG. 1 and FIG. 2, in the preferred embodiment of the present disclosure, the baby sleeping bag 100 may be placed in a baby carrier 200 such as a crib, a stroller, a baby cradle and a baby basket. When placed in the baby carrier 200, as shown in FIG. 1, the double thermal insulation can be realized through the arm securing structure 20 and the rolled cylindrical main body 11. When the temperature and environment are suitable, the opening of the main body 11 may also be opened as shown in FIG. 2, and the arm securing structure 20 are used for heat preservation.

Figure 3:
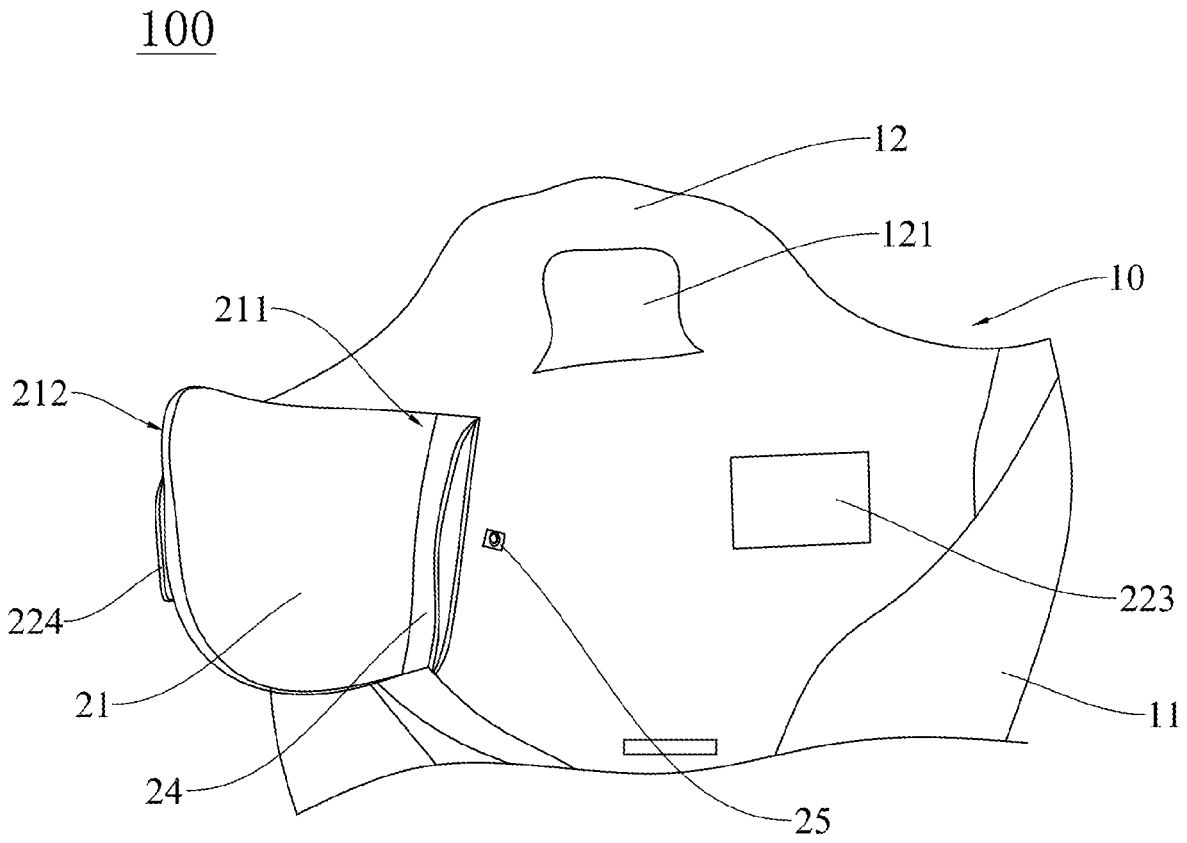
FIG. 3 is a schematic view of a use state of the arm securing structure according to the embodiment of the present disclosure.

Referring to FIGS. 2-8, the specific structure of the arm securing structure 20 in the baby sleeping bag 100 provided by the preferred embodiment of the present disclosure is described below:

As shown in FIG. 2 and FIG. 3, the securing sheet 21 is rectangular as a whole. In order to optimize the structure, a free end of the securing sheet 21 may have a certain radian. The securing sheet 21 has a connecting end 211 and the free end 212 located at its head and tail ends, and the connecting end 211 and the free end 212 are correspondingly connected to opposite sides (i.e., left and right sides) of the inner wall of the bag body 10. For ease of use, the securing sheet 21 may have a certain scalability, so as to wrap the upper body of the baby in the limit space 20*a*. Preferably, at least one of the connecting end 211 and the free end 212 is detachably connected with the inner wall of the bag body 10, so that the upper body of the baby can be more conveniently wrapped in the limit space 20*a*.

As shown in FIG. 2 and FIG. 3, specifically, in this embodiment, the number of the securing sheet 21 is one, the connecting end 211 of the securing sheet 21 is fixedly connected with the relatively left side of the inner wall of the bag body 10, the free end 212 of the securing sheet 21 is detachably connected with the relatively right side of the inner wall of the bag body 10. The arrangement in which one end is fixedly connected and the other end is detachably connected has simple structure and is easy to use and carry. Of course, in other embodiments, the connecting end 211 and the free end 212 may be detachably connected to the left and right sides of the bag body 10, respectively, so that the securing sheet 21 may be connected to or removed from the bag body 10 according to the actual needs, which has flexible use and strong adaptability.

As shown in FIG. 2 and FIG. 3, the arm securing structure 20 also includes a connecting member 22, the connecting member 22 may be arranged between the inner wall of the bag body 10 and the free end 212 or/and between the inner wall of the bag body 10 and the connecting end 211, so as to realize the detachable connection between the free end 212 or/and the connecting end 211 and the inner wall of the bag body 10. Specifically, the connecting member 22 is any one of a set of securing buckle and securing ring that are detachably matched, a plugging fastener, a snap fastener, a Velcro® or a bandage.

As shown in FIG. 2 and FIG. 3, the arm securing structure 20 also includes an adjusting element 23. The adjusting element 23 is arranged between the inner wall of the bag body 10 and the free end 212, or between the inner wall of the bag body 10 and the connecting end 211, or between the connecting end 211 and the free end 212 of the securing sheet 21. The adjusting element 23 is specifically arranged along the transverse width direction of the bag body 10 and has at least one adjusting section, so that a connection position between the free end 212 and the bag body 10 or between the connecting end 211 and the bag body 10 can be adjusted, or a spacing between the connecting end 211 and the free end 212 of the securing sheet 21 can be adjusted, so that a size of the limit space 20 *a* can be adjusted. The adjusting element 23 is any one of a set of securing buckle and securing ring that are detachably matched, a pull rope, a snap fastener, a Velcro® or a bandage.

As shown in FIG. 2, the connecting member 22 may be a snap fastener, which includes a male buckle 221 arranged on the inner wall of the bag body 10 and a female buckle 222 arranged on the free end 212 of the securing sheet 21. Through the cooperation between the male buckle 221 and the female buckle 222, the detachable connection between the free end 212 of the securing sheet 21 and the inner wall of the bag body 10 can be realized simply and effectively. In order to adjust the size of the limit space 20*a*, the adjusting element 23 may select a pull rope threaded on the securing sheet 21, and reduce or enlarge the relative length of the securing sheet 21 by operating the pull rope so as to adjust the size of the limit space 20*a*. Preferably, the number of male buckle 221 of the connecting member 22 may also be in plural, a plurality of male buckles 221 are spaced along the transverse width direction of the inner wall of the bag body 10, and the female buckle 222 on the free end 212 may be selectively buckled with the plurality of male buckles 221, so that the connection position between the free end 212 and the inner wall of the bag body 10 can be adjusted and the size of the limit space 20*a* can be changed accordingly. At this time, the connecting member 22 can perform the adjusting role of the adjusting element 23, thereby effectively simplifying the structure. Preferably, in order to strengthen the connection between the free end 212 of the securing sheet 21 and the bag body 10, the number of connecting member 22 may be in plural, and a plurality of connecting members 22 may be spaced along the longitudinal direction of the bag body 10 at the corresponding position of the inner wall of the bag body 10 and the free end 212, so as to improve the connection firmness through multi-point connection, and prevent the male buckle 221 of the connecting member 22 from separating from the female buckle 222 when the baby is moving.

Referring to FIG. 3, the connecting member 22 may be a Velcro®, which includes a male sticker 223 arranged on the inner wall of the bag body 10 and a female sticker 224 arranged on the free end 212 of the securing sheet 21. Through the thread gluing cooperation between the male sticker 223 and the female sticker 224, the detachable connection between the free end 212 of the securing sheet 21 and the inner wall of the bag body 10 can be realized simply and effectively. Moreover, selecting the Velcro® as the connecting member 22 can effectively simplify the structure, since it may be operated only by changing the length and width of the Velcro®. The change of the length can simply and effectively adjust the connection position between the free end 212 and the inner wall of the bag body 10, so as to change the size of the limit space 20 *a*. The change of the width can effectively increase the area of thread gluing, so as to strengthen the connection.

Figure 4:
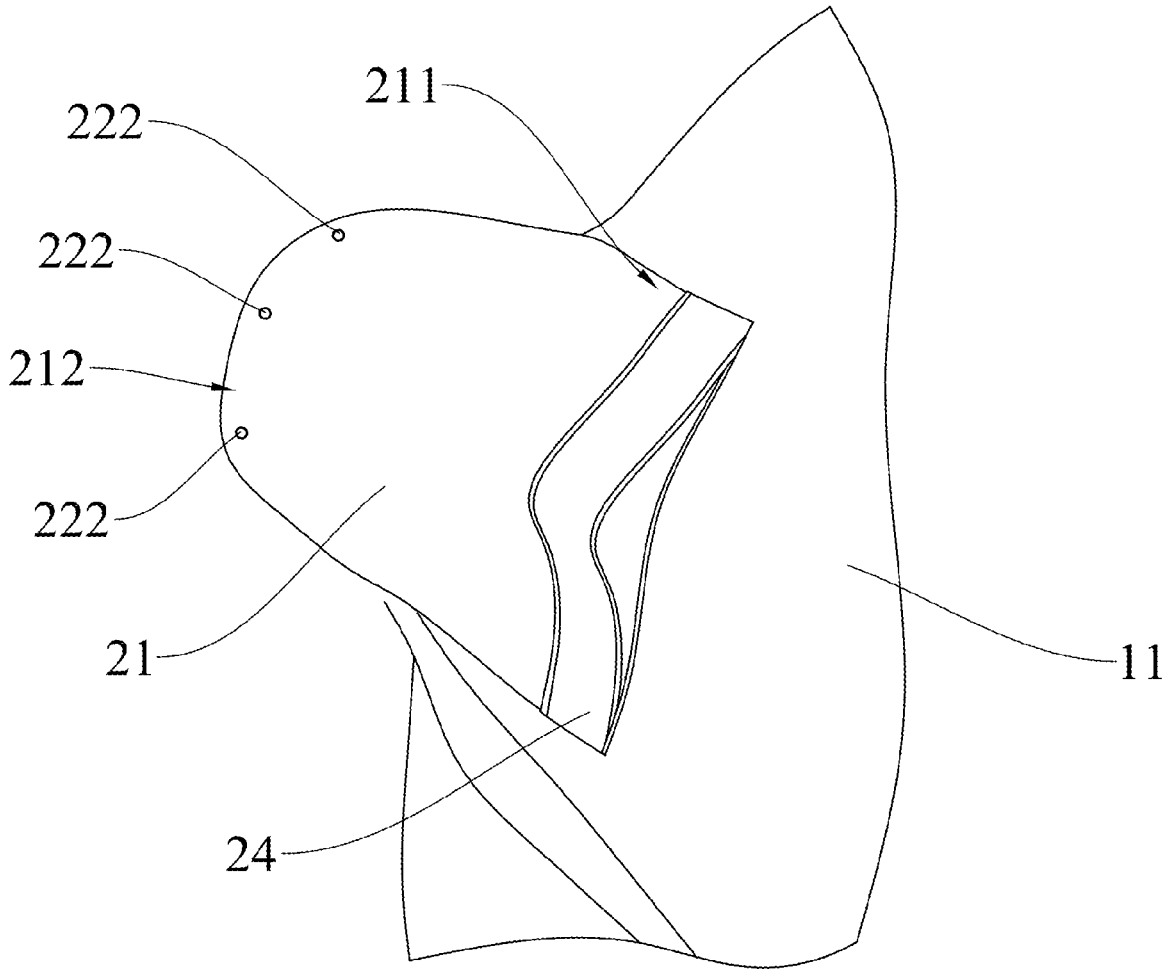
FIG. 4 is a schematic view of a structure of a storage bag of the arm securing structure.
Figure 6:
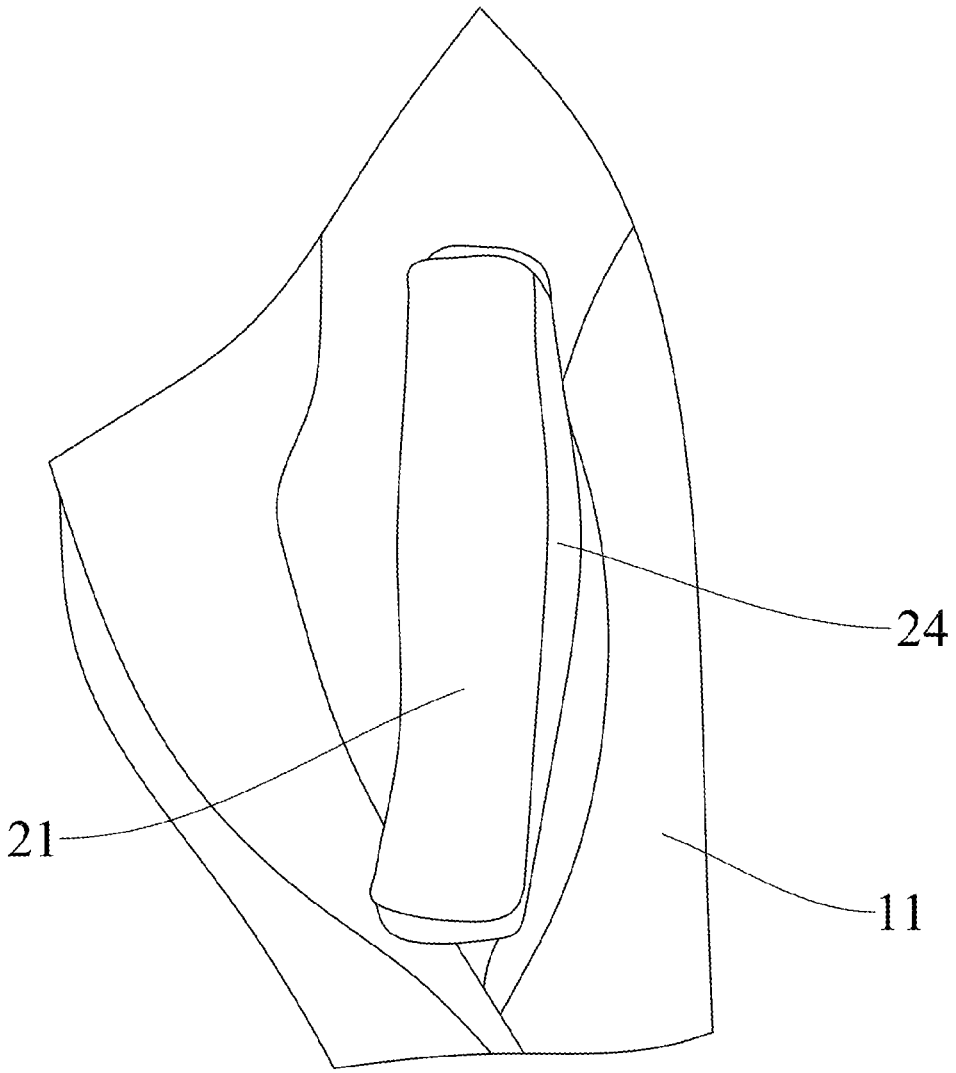
FIG. 6 is a schematic view of the securing sheet of the arm securing structure stored in the storage bag.

As shown in FIG. 4 and FIG. 6, the securing sheet 21 may be stored on the inner wall of the bag body 10 to facilitate carrying and use. Specifically, in this embodiment, the arm securing structure 20 also includes a storage bag 24. The storage bag 24 is arranged on the inner wall of the bag body 10 and is located near the connecting end 211 of the securing sheet 21. The securing sheet 21 may be rolled towards the storage bag 24 to be stored in the storage bag 24. The connecting end 211 of the securing sheet 21 is fixedly connected to the edge of the inner wall or outer wall of the storage bag 24, and the free end 212 of the securing sheet 21 may be rolled towards the storage bag 24 to be stored in the storage bag 24. The storage bag 24 may be connected to the inner wall of the bag body 10 by means of sewing, which has simple structure. The storage bag 24 may also be detachably connected to the inner wall of the bag body 10, so that the assembly and disassembly of the securing sheet 21 on the bag body 10 can be realized through the storage bag 24 according to the actual needs, so as to effectively improve the adaptability of the baby sleeping bag 100. Preferably, a mouth of the storage bag 24 may be provided with a sealing member (not shown in the figure), so that the securing sheet 21 can be better maintained in the storage state. Specifically, the sealing member is any one of a set of securing buckle and securing ring that are detachably matched, a pull rope, a snap fastener, a Velcro® or a bandage.

Figure 5:
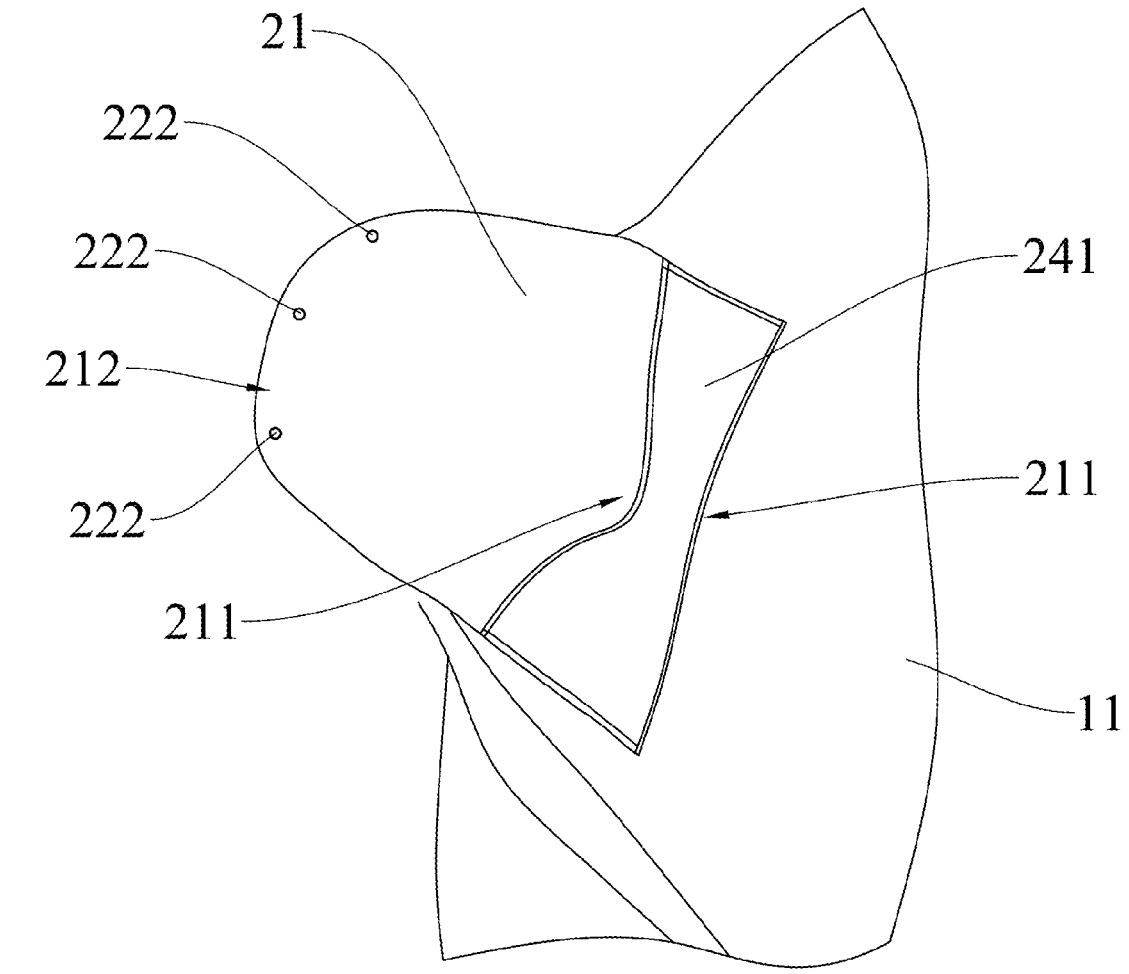
FIG. 5 is a schematic view of another structure of the storage bag of the arm securing structure.

As shown in FIG. 5 and FIG. 6, in order to simplify the structure of the storage bag 24, a cloth sheet 241 may also be connected by sewing at the position close to the connecting end 211 on the securing sheet 21. The securing sheet 21 is arranged on the inner wall of the bag body 10. Three sides of the cloth sheet 241 are sewn with the securing sheet 21, and the other side is not connected, so as to form the storage bag 24 with an opening between the cloth sheet 241 and the securing sheet 21. The securing sheet 21 may also be stored in the storage bag 24.

Figure 7:
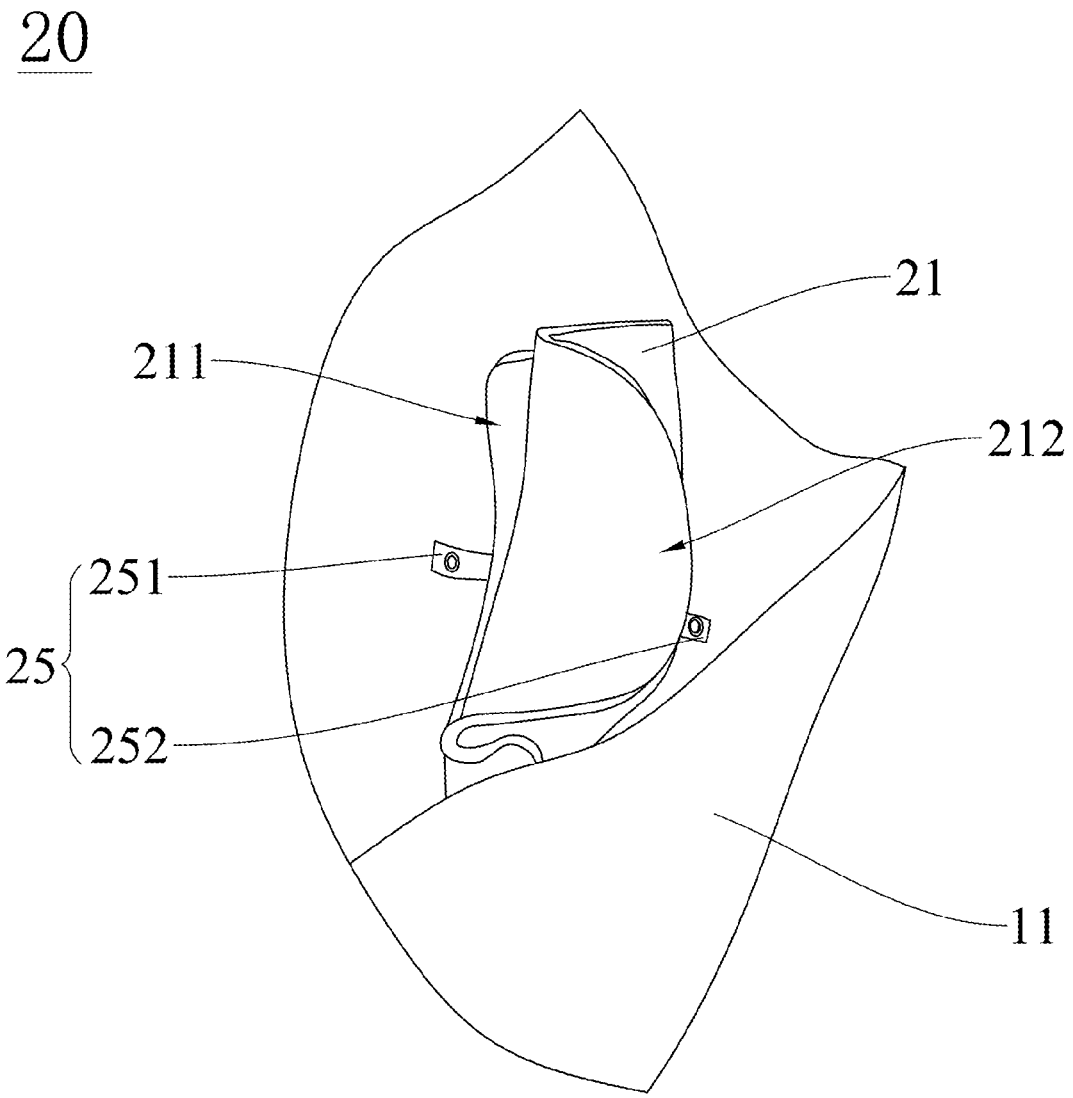
FIG. 7 is a structural schematic view of a folding member of the arm securing structure.
Figure 8:
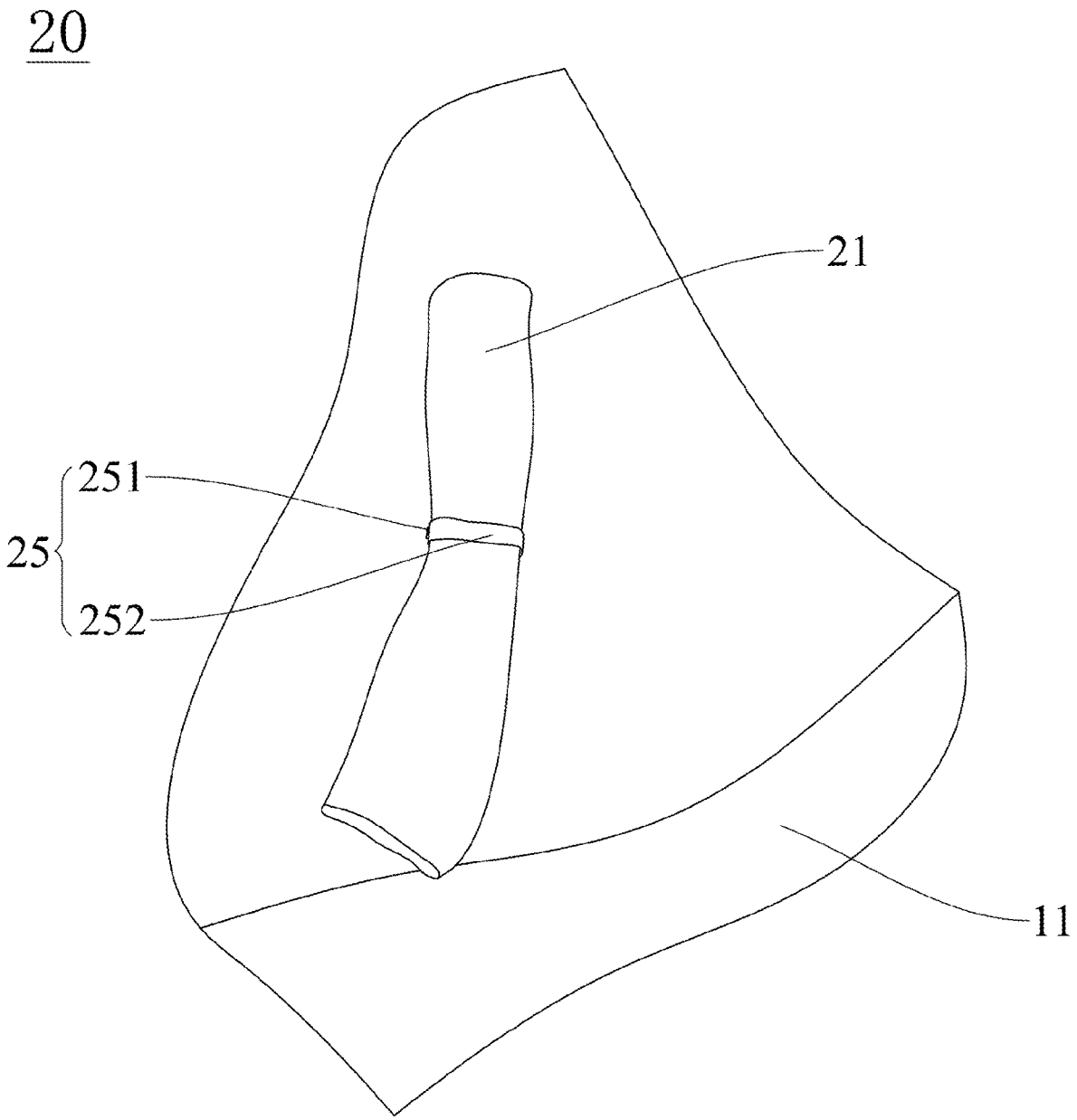
FIG. 8 is a schematic view of the securing sheet of the arm securing structure folded in the folding member.

As shown in FIG. 7 and FIG. 8, the securing sheet 21 may also be folded on the inner wall of the bag body 10. Specifically, the arm securing structure 20 also includes a folding member 25, the folding member 25 is arranged on the inner wall of the bag body 10 and arranged on the left and right sides of the securing sheet 21 along the transverse width direction of the bag body 10, so that the folded securing sheet 21 can be fixed on the bag body 10. Specifically, the folding member 25 is any one of a set of securing buckle and securing ring that are detachably matched, a plugging fastener, a snap fastener, a Velcro® or a bandage. As shown in FIG. 7, the folding member 25 may be a snap fastener, which includes a male buckle 251 and a female buckle 252 arranged on the opposite sides (i.e., left and right sides) of the securing sheet 21. Through the buckle connection between the male buckle 251 and the female buckle 252, the folded securing sheet 21 can be fixed simply and effectively. As shown in FIG. 8, the folding member 25 may also select a set of securing buckle 251 and securing ring 252 that are detachably matched.

Figure 9:
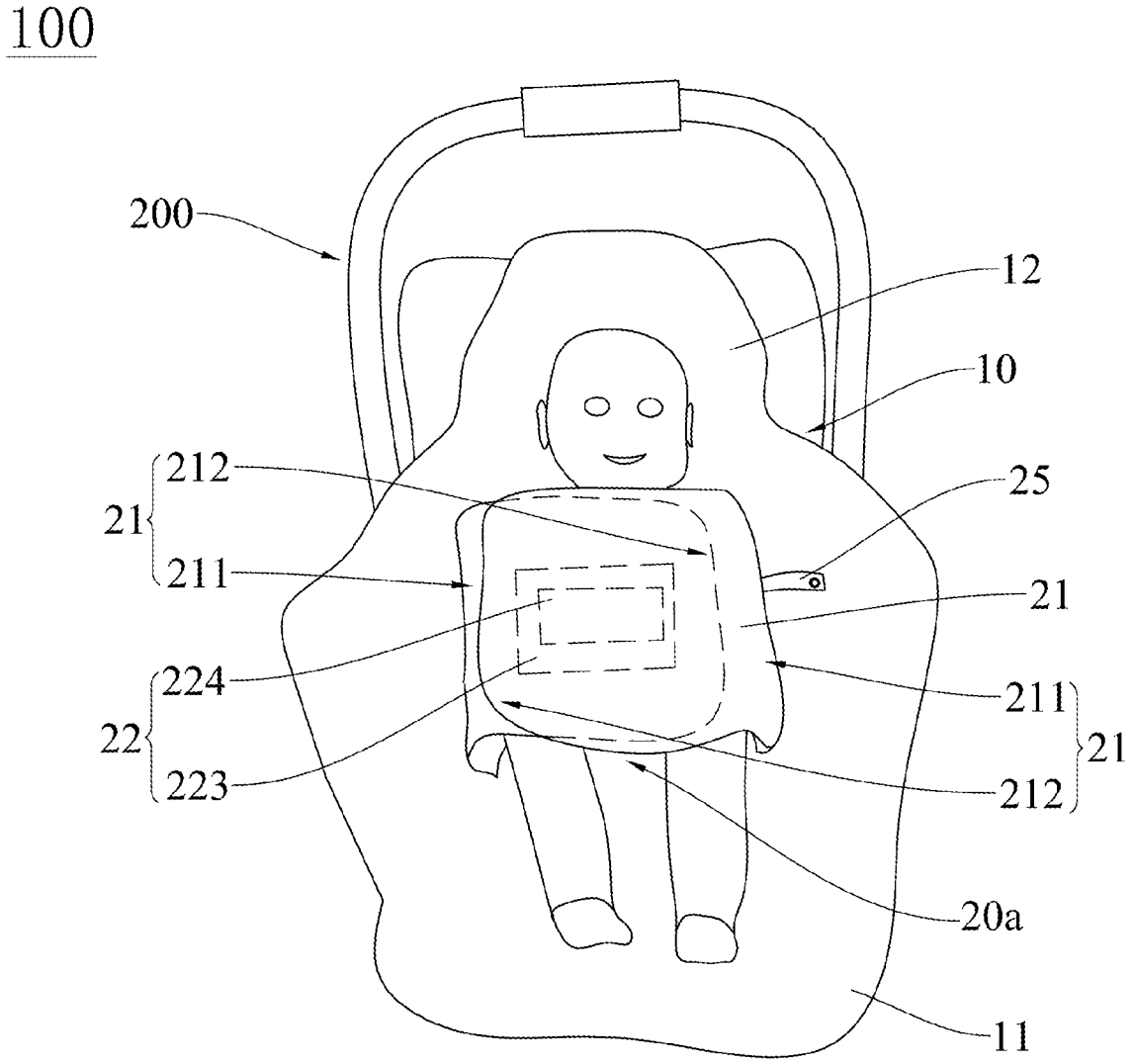
FIG. 9 is a structural schematic view of a baby sleeping bag according to another embodiment of the present disclosure.
Figure 10:
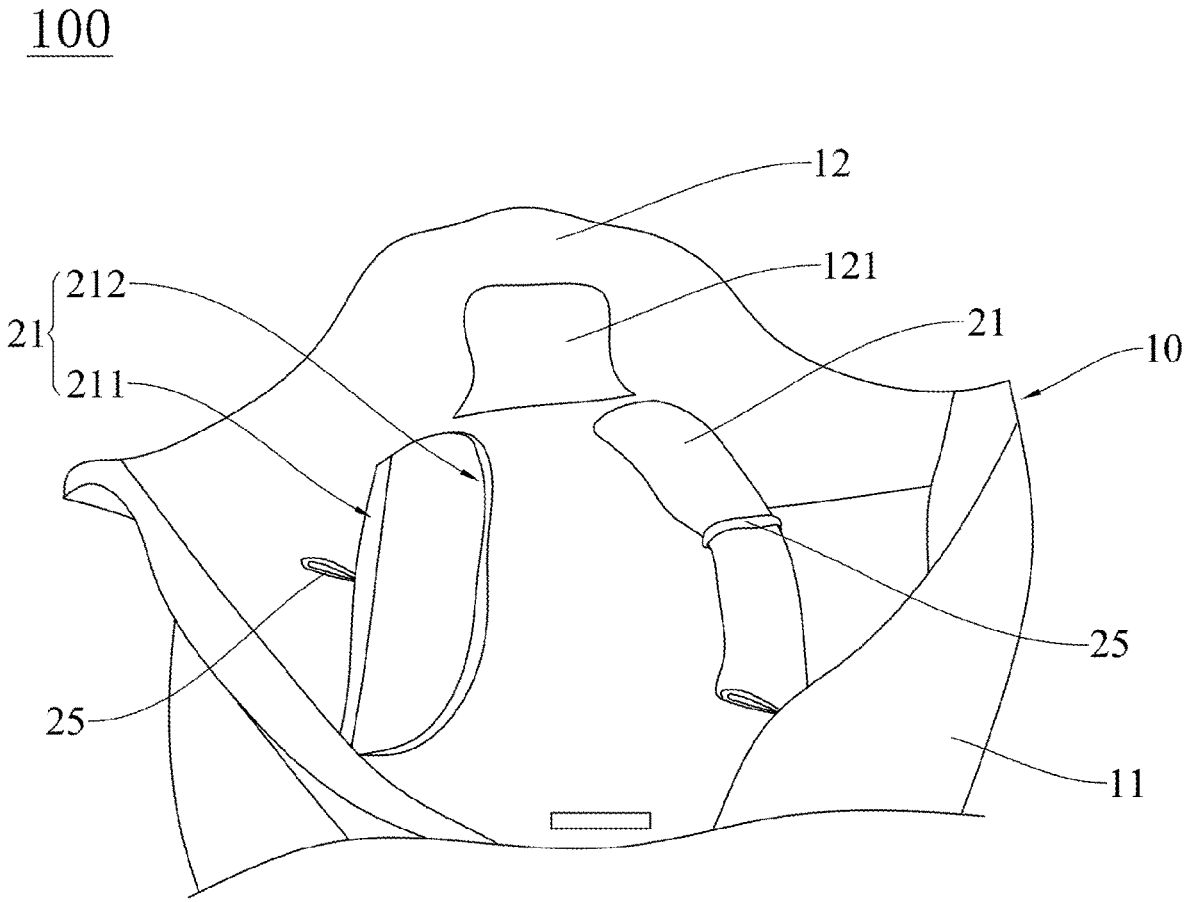
FIG. 10 is a structural schematic view of an arm securing structure according to the another embodiment of the present disclosure.

Referring to FIGS. 9-10, the specific structure of the arm securing structure 20 in the baby sleeping bag 100 provided by another preferred embodiment of the present disclosure is described below:

This embodiment is mainly different from the previous embodiment in that, the number of the securing sheet 21 is two, and the left and right opposite sides of the inner wall of the bag body 10 are respectively provided with a securing sheet 21 at the position corresponding to the baby's arm. Specifically, the connecting ends 211 of the two securing sheets 21 are correspondingly connected to the left and right opposite sides of the inner wall of the bag body 10, and the free ends 212 of the two securing sheets 21 are detachably connected. When connected, the blocked part of the securing sheet 21 located on the relatively lower side is illustrated by a dotted line in FIG. 9. The two securing sheets 21 may be arranged symmetrically, or the two securing sheets 21 may be arranged in different sizes.

Specifically, the two securing sheets 21 are detachably connected by means of superposing, lapping or docking. A connecting member 22 is correspondingly arranged between the free ends 212 of the two securing sheets 21 for the detachable connection between the free ends 212. Preferably, the connecting member 22 arranged between the free ends 212 may select a Velcro®, and the male sticker 223 and female sticker 224 of the Velcro® are shown as the dotted line in FIG. 9. Thus, the optional thread gluing of the male sticker 223 and female sticker 224 can not only perform connection, but also adjust the connection position therebetween, so that there is no need to add an adjusting element 23. Of course, a plurality of snap fastener style connecting members 22 may also be arranged on the free ends 212 of the two securing sheets 21 along the transverse width direction of the bag body 10 to adjust the connection position between the two securing sheets 21. In addition to being arranged between the free ends 212 of the two securing sheets 21, the adjusting element 23 may also be arranged between the connecting end 211 and the free end 212 of at least one securing sheet 21 or between the connecting end 211 of at least one securing sheet 21 and the inner wall of the bag body 10, and the size of the limit space 20 *a* may also be adjusted.

Compared with the prior art, the arm securing structure 20 of the baby sleeping bag 100 provided by the present disclosure is arranged in the bag body 10 for easy carrying and use, wherein the securing sheet 21 of the arm securing structure 20 is arranged on the inner wall of the bag body 10 along the transverse width direction of the bag body 10, so that a limit space 20*a* for securing the arms of the baby may be formed between the securing sheet 21 and the inner wall of the bag body 10. When the baby lies in the sleeping bag, the upper body of the baby may be wrapped in the limit space 20*a* defined by the securing sheet 21 and the inner wall of the bag body 10, so as to limit the movement of the arms of the baby, effectively prevent the arms from being stretched out of the sleeping bag, and thus avoid the baby from catching a cold. The baby sleeping bag 100 of the present disclosure has simple structure and is easy to use. In addition, due to the adjustable size of the limit space 20*a*, it is convenient for the baby to be placed in the sleeping bag, further improving the convenience of use, facilitating to be used for babies of different statures, and effectively improving the adaptability of the baby sleeping bag 100.

It should be noted that the structure and connection mode of other parts of the baby sleeping bag 100 of the present disclosure are not the key points sought to be protected by the present disclosure, which will not be described in detail herein.

The above disclosure is only the preferred embodiments of the present disclosure. Of course, it cannot limit the scope of the present disclosure. Therefore, the equivalent changes made according to the scope of the present disclosure still belong to the scope covered by the present disclosure.

What is claimed is:

1. A baby sleeping bag, comprising:

a bag body; and an arm securing structure arranged in the bag body, the arm securing structure comprises:

a securing sheet arranged on an inner wall of the bag body along a transverse width direction of the bag body, the securing sheet comprising a connecting end and a free end, the connecting end and the free end are correspondingly connected to left and right sides of the bag body, and at least one of the connecting end and the free end is detachably connected with the bag body;

a limit space for securing arms of a baby is formed between the securing sheet and the inner wall of the bag body, wherein a size of the limit space is adjustable; and a storage bag arranged on the inner wall of the bag body and adjacent the connecting end of the securing sheet, the securing sheet being configured to be rolled towards and positioned within the storage bag so as to be stored in the storage bag.

2. The baby sleeping bag of claim 1, wherein the securing sheet comprises one securing sheet, the connecting end of the securing sheet is fixedly connected with the left side of the bag body, and the free end of the securing sheet is detachably connected with the right side of the bag body.

3. The baby sleeping bag of claim 1, wherein the securing sheet comprises two securing sheets comprising a first securing sheet and a second securing sheet, the two securing sheets are respectively provided on the left and right sides of the bag body at a position corresponding to each arm of the baby, and the free end of the first securing sheet and the free end of the second securing sheet are detachably connected.

4. The baby sleeping bag of claim 3, wherein the two securing sheets are symmetrically arranged.

5. The baby sleeping bag of claim 3, wherein the free end of the first securing sheet and the free end of the second securing sheet are detachably connected by means of superposing, lapping or docking.

6. The baby sleeping bag of claim 3, wherein the arm securing structure further comprises a connecting member, and the connecting member is arranged between the free end of the first securing sheet and the free end of the second securing sheet to realize detachable connection between the free ends of the two securing sheets.

7. The baby sleeping bag of claim 1, wherein the arm securing structure further comprises a connecting member, and the connecting member is arranged between the inner wall of the bag body and the free end or/and between the inner wall of the bag body and the connecting end, so as to realize detachable connection between the free end or/and the connecting end and the inner wall of the bag body.

8. The baby sleeping bag of claim 6, wherein the connecting member is any one of a set of securing buckle and securing ring that are detachably matched, a plugging fastener, a snap fastener, or a hook and loop fastener.

9. The baby sleeping bag of claim 3, wherein the arm securing structure further comprises an adjusting element, the adjusting element is arranged between the free end of the first securing sheet and the free end of the second securing sheet, or between the connecting end and the free end of at least one of the securing sheets, or between the connecting end of at least one of the securing sheets and the inner wall of the bag body, and the adjusting element is arranged along the transverse width direction of the bag body and has at least one adjusting section to adjust a size of the limit space.

10. The baby sleeping bag of claim 1, wherein the arm securing structure further comprises an adjusting element, the adjusting element is arranged between the inner wall of the bag body and the free end, or between the inner wall of the bag body and the connecting end, or between the connecting end and the free end of the securing sheet, and the adjusting element is arranged along the transverse width direction of the bag body and is provided with at least one adjusting section to adjust a size of the limit space.

11. The baby sleeping bag of claim 9, wherein the adjusting element is any one of a set of securing buckle and a securing ring that are detachably matched, a pull rope, a snap fastener, or a hook and loop fastener.

12. The baby sleeping bag of claim 1, wherein the free end of the securing sheet has a radian or is at least partially rounded, and the connecting end of the securing sheet is rectangular in shape.

13. The baby sleeping bag of claim 1, wherein the securing sheet is stored or folded on the inner wall of the bag body.

14. The baby sleeping bag of claim 1, wherein the connecting end of the securing sheet is fixedly connected to an edge of an inner wall or outer wall of the storage bag, and the free end of the securing sheet is configured to be rolled towards and positioned within the storage bag so as to be stored in the storage bag.

15. The baby sleeping bag of claim 1, wherein the storage bag is sewn or detachably connected to the inner wall of the bag body, and a mouth of the storage bag is provided with a sealing member.

16. The baby sleeping bag of claim 1, wherein a cloth sheet is connected to the securing sheet by means of sewing at a position adjacent the connecting end of the securing sheet, and the storage bag with an opening is formed between the cloth sheet and the securing sheet.

17. The baby sleeping bag of claim 13, wherein the arm securing structure further comprises a folding member arranged on the inner wall of the bag body and arranged on the left and right sides of the securing sheet along the transverse width direction and within a perimeter of the bag body, wherein the folding member is configured to fix the securing sheet folded on the bag body.

18. The baby sleeping bag of claim 17, wherein the folding member is any one of a set of securing buckle and securing ring that are detachably matched, a plugging fastener, a snap fastener, or a hook and loop fastener.

19. The baby sleeping bag of claim 1, wherein the securing sheet is scalable to adjust the size of the limit space.

20. The baby sleeping bag of claim 1, wherein the bag body comprises a main body and a head cover that are integrally connected, the head cover is protruded at a top side end of the main bag, the securing sheet is arranged on the main body along a transverse width direction thereof, and the main body is provided with a closable opening arranged along a longitudinal direction thereof.

21. A baby sleeping bag, comprising:

a bag body; and an arm securing structure arranged in the bag body, the arm securing structure comprises:

a securing sheet arranged on an inner wall of the bag body along a transverse width direction of the bag body, the securing sheet comprising a connecting end and a free end, the connecting end and the free end are correspondingly connected to left and right sides of the bag body, and at least one of the connecting end and the free end is detachably connected with the bag body;

a limit space for securing arms of a baby is formed between the securing sheet and the inner wall of the bag body, wherein a size of the limit space is adjustable; and a storage bag arranged on the inner wall of the bag body, the securing sheet being configured to be rolled towards and positioned within the storage bag so as to be stored in the storage bag, wherein a cloth sheet is connected to the securing sheet by means of sewing at a position adjacent the connecting end of the securing sheet, and the storage bag with an opening is formed between the cloth sheet and the securing sheet.

* * * * *